US008754727B2

(12) United States Patent
McCoy et al.

(10) Patent No.: US 8,754,727 B2
(45) Date of Patent: Jun. 17, 2014

(54) DEVICES, SYSTEMS, AND METHODS FOR SHUNTING A CIRCUIT BREAKER

(75) Inventors: Brian Timothy McCoy, Lawrenceville, GA (US); Thomas William Holland, Flowery Branch, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 980 days.

(21) Appl. No.: 11/796,995

(22) Filed: Apr. 30, 2007

(65) Prior Publication Data

US 2007/0290775 A1 Dec. 20, 2007

Related U.S. Application Data

(60) Provisional application No. 60/745,939, filed on Apr. 28, 2006.

(51) Int. Cl.

| | |
|---|---|
| ***H01H 75/08*** | (2006.01) |
| ***H01H 77/04*** | (2006.01) |
| ***H01H 81/02*** | (2006.01) |

(52) U.S. Cl.

USPC ..... 335/43

(58) Field of Classification Search

USPC ..... 335/43

See application file for complete search history.

(56) References Cited

U.S. PATENT DOCUMENTS

| | | | | |
|---|---|---|---|---|
| 2,989,605 | A * | 6/1961 | Leonard | 335/35 |
| 3,096,413 | A * | 7/1963 | Gryctko et al. | 335/43 |
| 4,675,635 | A * | 6/1987 | DiMarco et al. | 335/35 |
| 4,675,640 | A * | 6/1987 | DiMarco et al. | 337/70 |
| 5,872,495 | A * | 2/1999 | DiMarco et al. | 335/35 |
| 6,515,569 | B2 * | 2/2003 | Lias et al. | 337/37 |
| 6,822,543 | B1 | 11/2004 | Brignoni | |
| 2002/0075123 | A1 | 6/2002 | Erb | |

FOREIGN PATENT DOCUMENTS

| | | | |
|---|---|---|---|
| CN | 1360327 | A | 7/2002 |

* cited by examiner

*Primary Examiner* — Alexander Talpalatski

(57) ABSTRACT

Certain exemplary embodiments comprise a bimetal restraint adapted to restrain a bimetal of a circuit breaker from deformation beyond a predetermined threshold during a short circuit event. In certain exemplary embodiments, the bimetal restraint can be adapted to act as a shunt during the short circuit event to transfer electrical energy from an electrical energy source to a load side of the circuit breaker.

19 Claims, 13 Drawing Sheets

DEVICES, SYSTEMS, AND METHODS FOR SHUNTING A CIRCUIT BREAKER

CROSS-REFERENCES TO RELATED APPLICATIONS

This application claims priority to, and incorporates by reference herein in its entirety, pending U.S. Provisional Patent Application Ser. No. 60/745,939, filed 28 Apr. 2006.

BACKGROUND

U.S. Pat. No. 5,432,491 (Peter), which is incorporated by reference herein in its entirety, allegedly discloses a "bimetal controlled circuit breaker includes a current bus that is electrically connected in series with the bimetal element. The current bus extends parallel to the bimetal element in the deflection plane of the latter and is rigid relative to the bimetal element. The deflection of the bimetal element is supported by the action of electrodynamic forces. In order for the circuit breaker to be suitable for greater current intensities and the effect of the electrodynamic forces to be better utilized, the bimetal element is electrically connected in parallel with a shunt path." See Abstract.

U.S. Pat. No. 5,864,266 (Mickelson), which is incorporated by reference herein in its entirety, allegedly discloses a "reverse deflection prevention arrangement is provided for use in a circuit breaker for preventing a bimetal from bending in a direction opposite its normal thermal deflection. The reverse deflection prevention arrangement includes a tab portion extending from a yoke and a corresponding block member disposed on the inside surface of a circuit breaker cover. The tab portion engages the block member when the bimetal is forced to deflect in the direction opposite its normal deflection. An alternate embodiment of the reverse deflection prevention arrangement includes a reinforcement member secured to one end of the bimetal. The reinforcement member strengthens and supports the bimetal so that it is prevented from bending in the direction opposite its normal thermal deflection." See Abstract.

SUMMARY

Certain exemplary embodiments comprise a bimetal restraint adapted to restrain a bimetal of a circuit breaker from deformation beyond a predetermined threshold during a short circuit event. In certain exemplary embodiments, the bimetal restraint can be adapted to act as a shunt during the short circuit event to transfer electrical energy from an electrical energy source to a load side of the circuit breaker.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments provide a bimetal restraint adapted to restrain a bimetallic strip (hereinafter "bimetal") of a circuit breaker from deformation beyond a predetermined threshold during a short circuit event. In certain exemplary embodiments, the bimetal restraint can be adapted to act as a shunt during the short circuit event to transfer electrical energy from an electrical energy source to a load side of the circuit breaker.

During a short circuit event, the bimetal in a circuit breaker can be pushed in a direction opposite of a direction that the bimetal bends in order to trip the circuit breaker. This can be caused by electromagnetic repulsion between the bimetal and a load terminal of the circuit breaker. As a result, the bimetal can inelastically deform such that the bimetal is in a position too far away from an armature latch to be able to bend enough to trip the circuit breaker under thermal conditions wherein a trip of the circuit breaker might be desirable. In certain exemplary embodiments, a bimetal restraint can create a physical barrier adapted to block a free end of the bimetal from going to a position that might prevent the bimetal from tripping the circuit breaker under thermal conditions wherein a trip of the circuit breaker might be desirable. The bimetal restraint can be adapted for springably attachable fastenerless installation in a case of the circuit breaker or can be molded into a portion of the circuit breaker and/or the case of the circuit breaker, such as via one or more plastic moldings. A springably attachable fastenerless bimetal restraint can be modified in several ways (such as potentially in conjunction with a spring that can be part of the springably attachable fastenerless bimetal restraint or a separate part) that might allow the bimetal to pass by the bimetal restraint during calibration but not allow the bimetal to move back to an undesired position relative to the armature latch after calibration. The bimetal restraint can also be used as a "shunt" (either with or without a set of contacts) that can be tied into a current path and when the bimetal makes electrical contact with the bimetal restraint. A created secondary electrical circuit formed thereby can carry electrical energy to a load side (such as a lug) of the circuit breaker.

Figure 1:
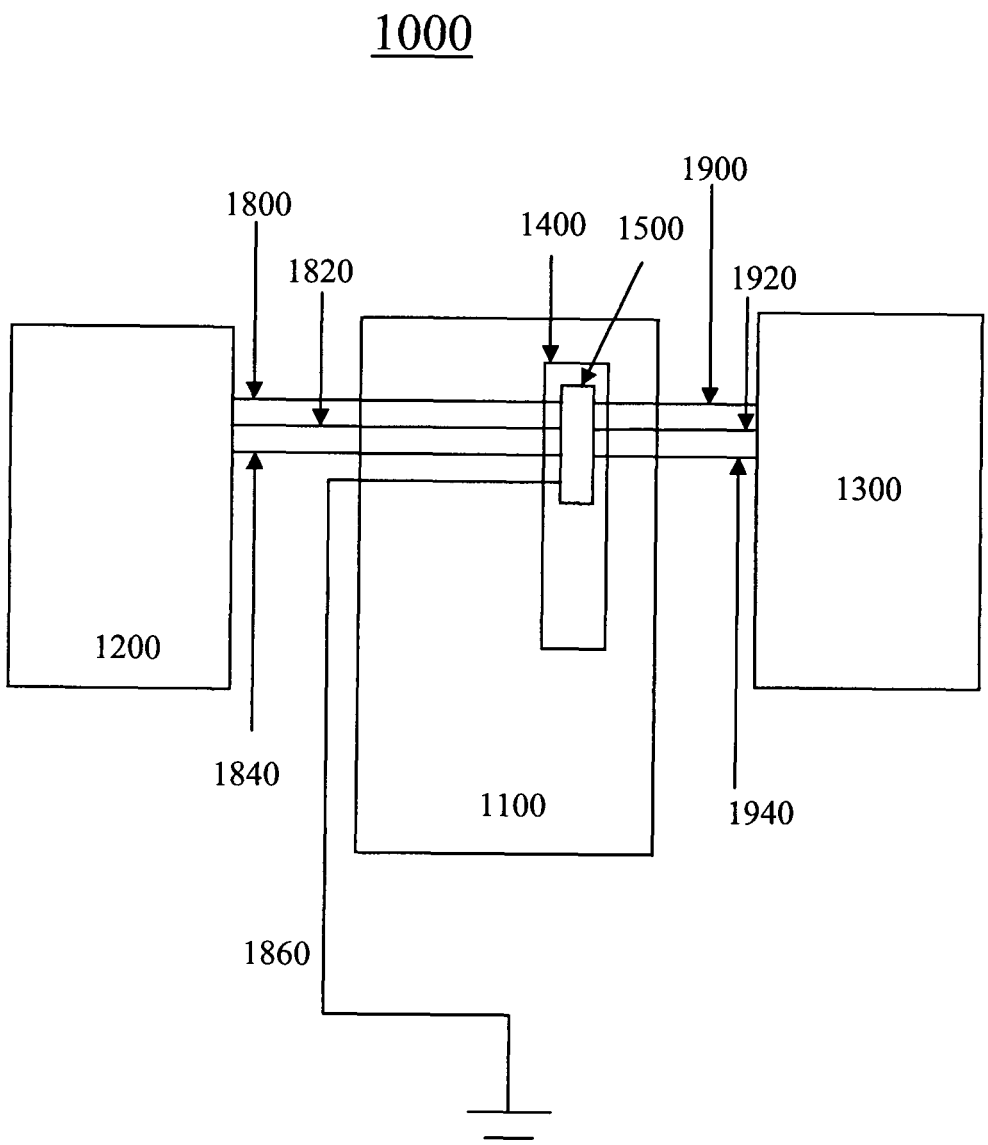
FIG. 1 is a block diagram of an exemplary embodiment of a system 1000.

FIG. 1 is a block diagram of an exemplary embodiment of a system 1000, which can comprise an electrical panel 1100. Electrical panel 1100 can be utilized to electrically couple an electrical source 1200 to an electrical load 1300. Electrical load 1300 can be associated with a home, factory, office building, commercial warehouse, store, government building, construction site, sports facility, mobile plant, camp site, recreational facility, trailer home, emergency site, and/or farm, etc.

Electrical panel 1100 can comprise one or more basepans 1400, which can be operatively coupled to one or more circuit breaker cases 1500. Components comprised by circuit breaker case 1500 can be operably energizable by 100 volts or greater. A first plurality of conductors can electrically couple electrical source 1200 to components comprised by circuit breaker case 1500. The first plurality of conductors can comprise a first source conductor 1800, a second source conductor 1820, and a third source conductor 1840. A ground 1860 can be electrically coupled to a component of circuit breaker case 1500. Each of first source conductor 1800, second source conductor 1820, third source conductor 1840, and/or ground 1860 can be operably connectable to one or more circuit breakers, such as one or more components comprised by circuit breaker case 1500.

A second plurality of conductors can electrically couple electrical load 1300 to one or more components comprised by circuit breaker case 1500. The second plurality of conductors can comprise a first load conductor 1900, a second load conductor 1920, and a third load conductor 1940. Each of second load conductor 1920, third load conductor 1940, and/or ground 1860 can be operably connectable to one or more circuit breakers, such as components comprised by circuit breaker case 1500.

Figure 2:
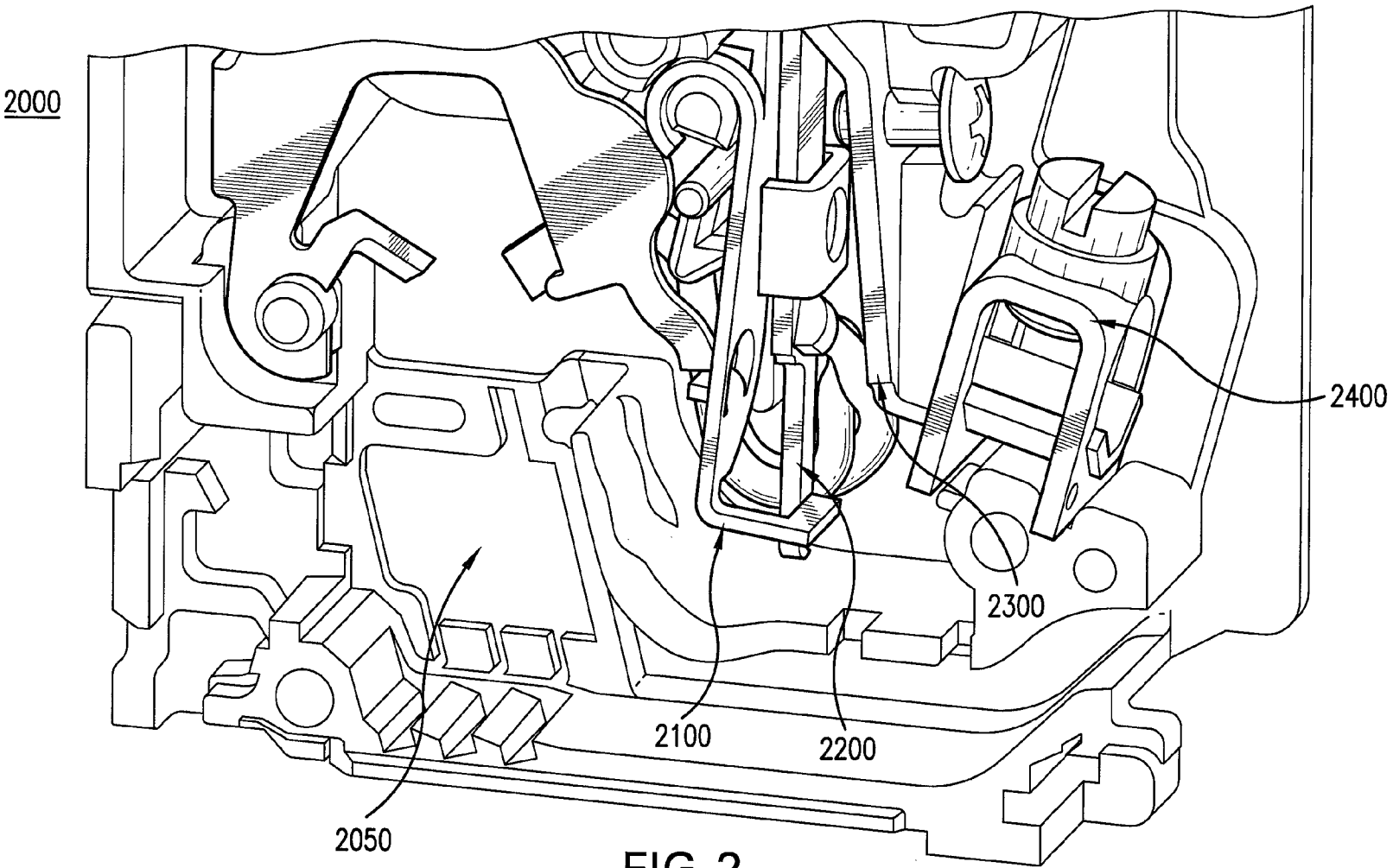
FIG. 2 is a perspective view of an exemplary embodiment of a system 2000.

FIG. 2 is a perspective view of an exemplary embodiment of a system 2000, which can comprise a circuit breaker case 2050. Case 2050 can comprise and/or be coupled to a plurality of assembled components such as an armature latch 2100. Case 2050 can comprise a bimetal 2200, which can be adapted to trip the circuit breaker to remove electrical energy from an electrical circuit electrically coupled to an electrical energy source by the circuit breaker. Armature latch 2100 can be adapted to remove electrical energy from a load side of the circuit breaker responsive to a movement of bimetal 2200. Electrical energy can be conducted from the electrical energy source to the electrical circuit via a load terminal 2300 and/or a lug 2400. Lug 2400 can be adapted to be coupled to an electrical conductor that is electrically coupleable to the electrical circuit. In certain operative embodiments, the circuit breaker can transfer electrical energy from the electrical source to the electrical circuit until bimetal 2200 makes contact with armature latch 2100.

Figure 3:
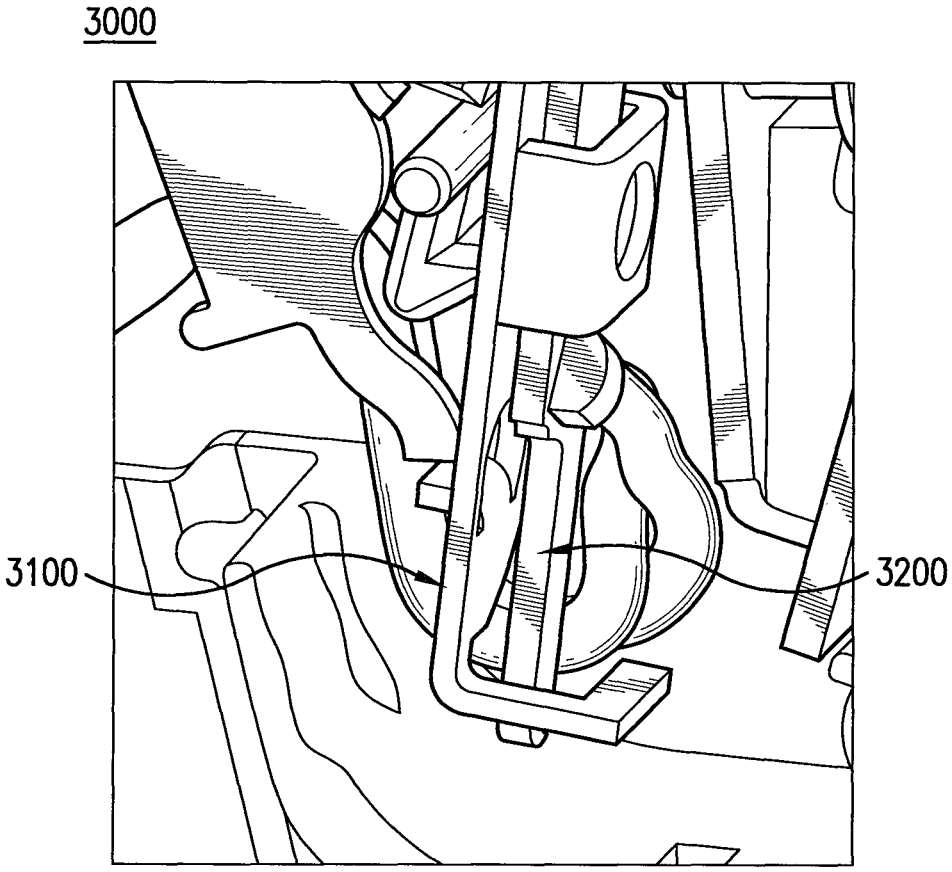
FIG. 3 is a perspective view of an exemplary embodiment of a system 3000.

FIG. 3 is a perspective view of an exemplary embodiment of a system 3000, which can comprise and armature latch 3100 and a bimetal 3200. In certain exemplary embodiments, bimetal 3200 can be deformed via electromagnetic forces during a short circuit event. In certain exemplary embodiments, the deformation of bimetal 3200 can result in a substantially inelastic deformation that positions bimetal 3200 at an excessive distance from armature latch 3100. The excessive distance can be such that bimetal 3200 will not contact armature latch 3100 when a temperature of bimetal 3200 exceeds a predetermined threshold at which a trip of the circuit breaker might be desired.

Figure 4:
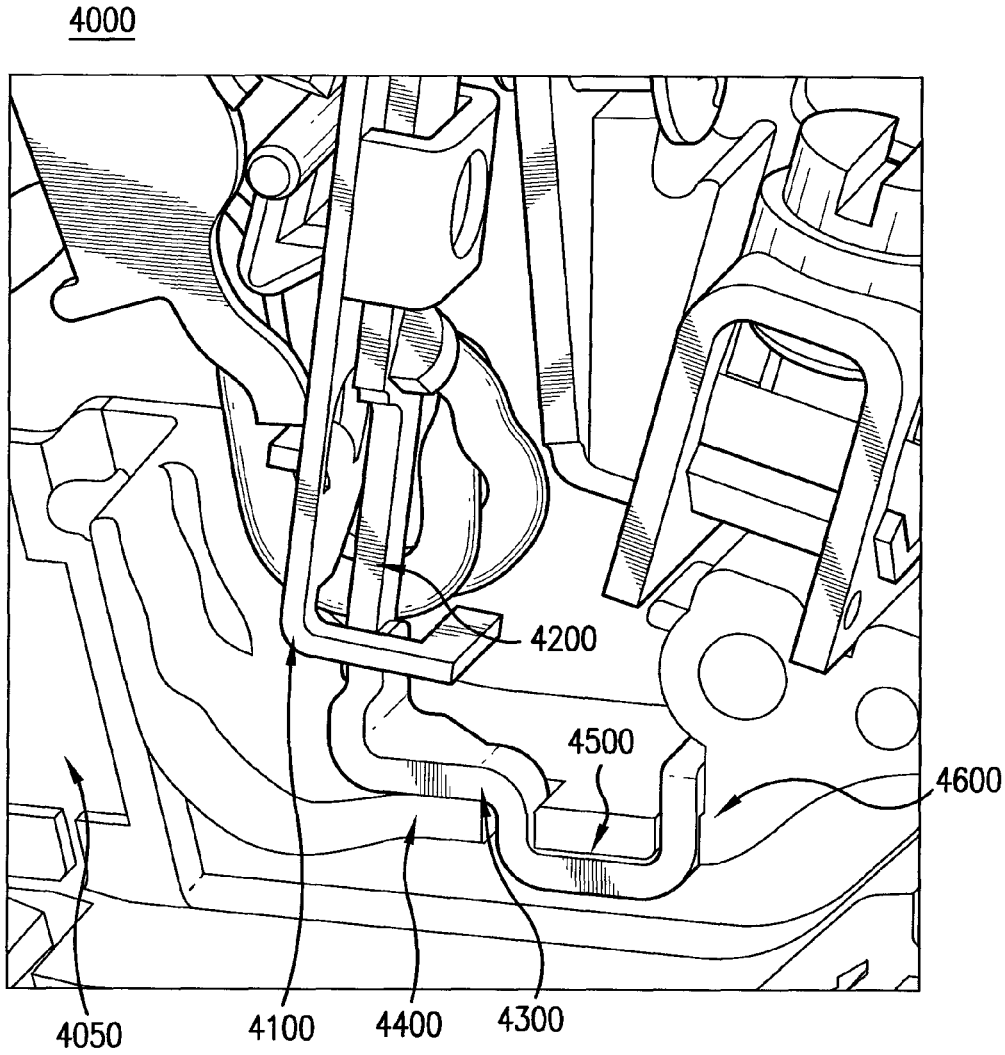
FIG. 4 is a perspective view of an exemplary embodiment of a system 4000.

FIG. 4 is a perspective view of an exemplary embodiment of a system 4000, which can comprise an armature latch 4100, a bimetal 4200, and a bimetal restraint 4300. Bimetal restraint 4300 can be adapted to restrain motion of bimetal 4200 such that bimetal 4200 does not deform and/or move to a position beyond which bimetal 4200 can trip a circuit breaker responsive to a temperature exceeding a predetermined threshold.

Bimetal restraint 4300 can be fastenerless, and/or can be adapted to be releasably, springably, biasedly, and/or fastenerlessly seated between at least two surfaces, such as retainer surface 4400, retainer surface 4500, and/or retainer surface 4600, of circuit breaker case 4050. Bimetal restraint 4300 can be adapted to be releasably seated in circuit breaker case 4050. Bimetal restraint 4300 can be adapted to contact and/or rest on at least one surface, such as retainer surface 4400, retainer surface 4500 and retainer surface 4600 defined by circuit breaker case 4050. Bimetal restraint 4300 can be adapted to be installed, secured, and/or retained in circuit breaker case 4050 via tension, bias, and/or releasable and/or elastic deformation. Bimetal restraint 4300 can be adapted to be nondestructively removed from circuit breaker case 4050, such as substantially without utilizing a tool, and/or via a gripping tool such as needle-nosed pliers.

Figure 5:
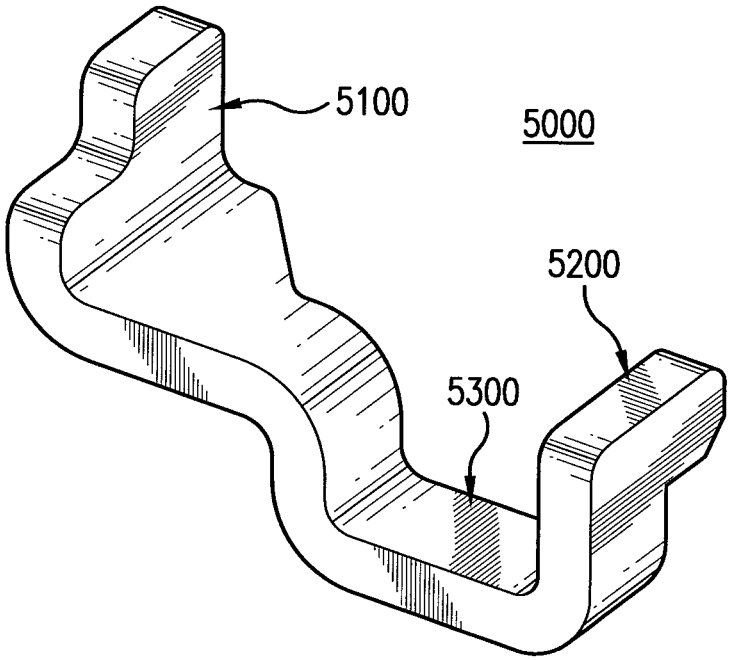
FIG. 5 is a perspective view of an exemplary embodiment of a bimetal restraint 5000.

FIG. 5 is a perspective view of an exemplary embodiment of a bimetal restraint 5000, which can be adapted to be fastenerlessly installed in a circuit breaker case. Bimetal restraint 5000 can comprise a prong 5100, which can be adapted, in certain operative embodiments, to restrain a bimetal in a circuit breaker from deformation and/or movement beyond a predetermined position. Bimetal restraint 5000 can comprise an end region 5200 and/or a recessed portion 5300. End region 5200 and/or recessed portion 5300 can be adapted, in certain operative embodiments, to restrain motion of the bimetal restrain within the circuit breaker case. Bimetal restrain 5000 can be adapted for fastenerless installation in the circuit breaker case.

Figure 6:
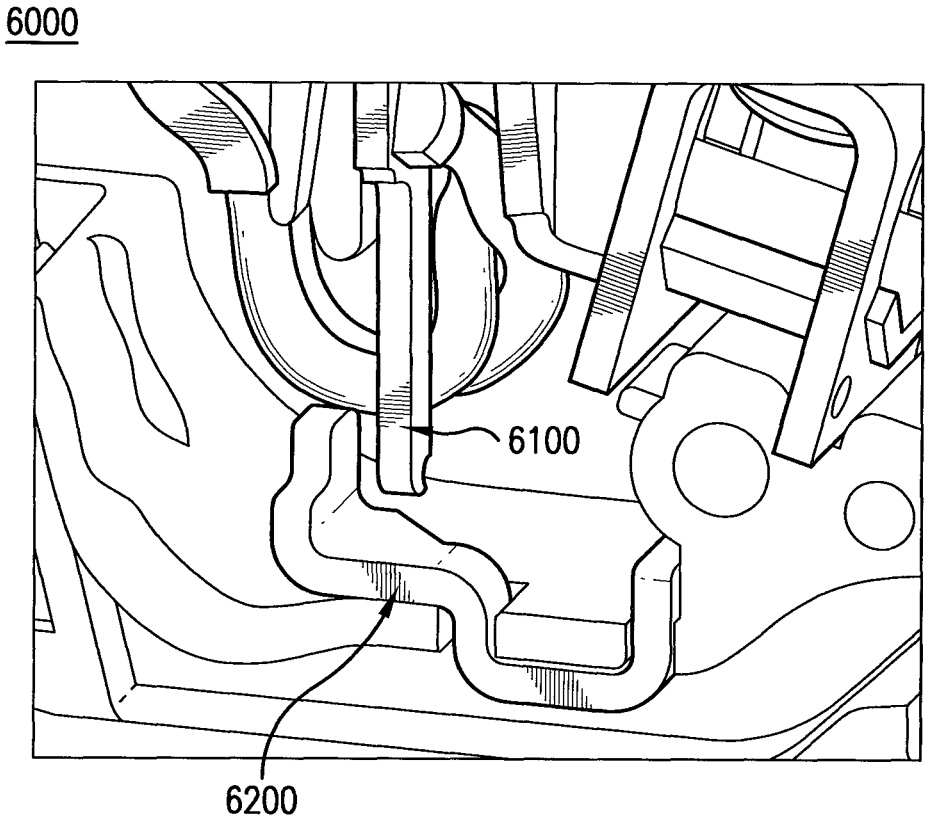
FIG. 6 is a perspective view of an exemplary embodiment of a system 6000.

FIG. 6 is a perspective view of an exemplary embodiment of a system 6000, which can comprise a bimetal 6100 and a bimetal restraint 6200. Bimetal 6100 can be set in a calibrated position relative to bimetal restraint 6200 and/or an armature latch (not illustrated in system 6000). The calibrated position can be such that bimetal 6100 is adapted to trip a circuit breaker of system 6000 responsive to a temperature in the circuit breaker exceeding a predetermined threshold, such as due to an excessive current and/or voltage of electrical energy conducted via the circuit breaker.

Figure 7:
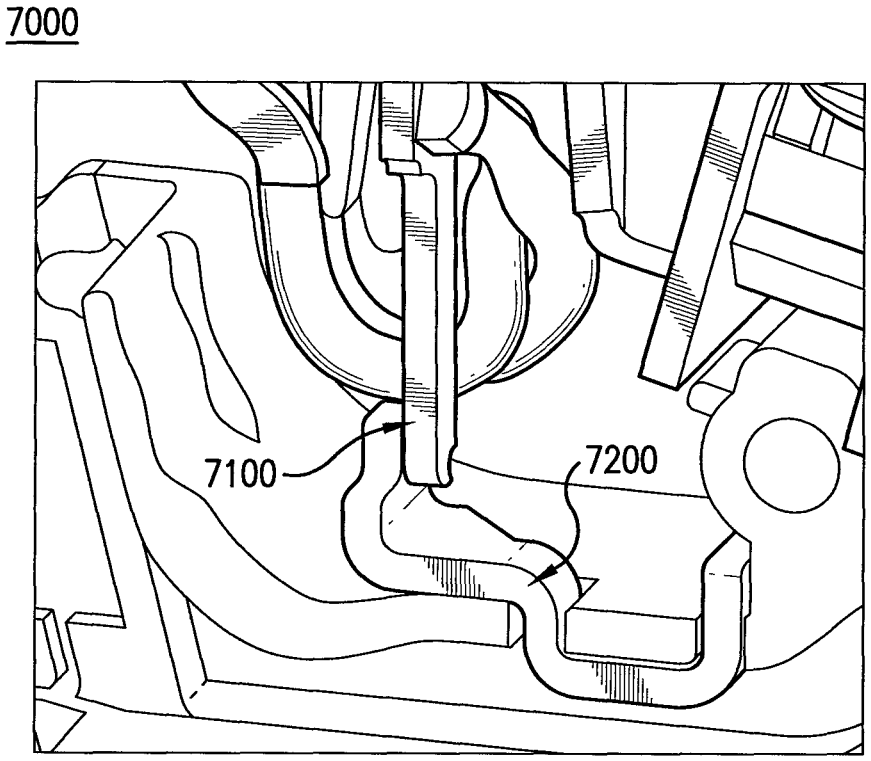
FIG. 7 is a perspective view of an exemplary embodiment of a system 7000.

FIG. 7 is a perspective view of an exemplary embodiment of a system 7000, which can comprise a bimetal 7100 and a bimetal restraint 7200. In certain exemplary embodiments, bimetal restraint 7200 can be adapted to restrain motion of bimetal 7100 beyond a predetermined threshold. Bimetal 7100 might otherwise move beyond the predetermined threshold responsive to electromagnetic conditions within a circuit breaker case of system 7000, such as might occur during a short circuit event.

Figure 8:
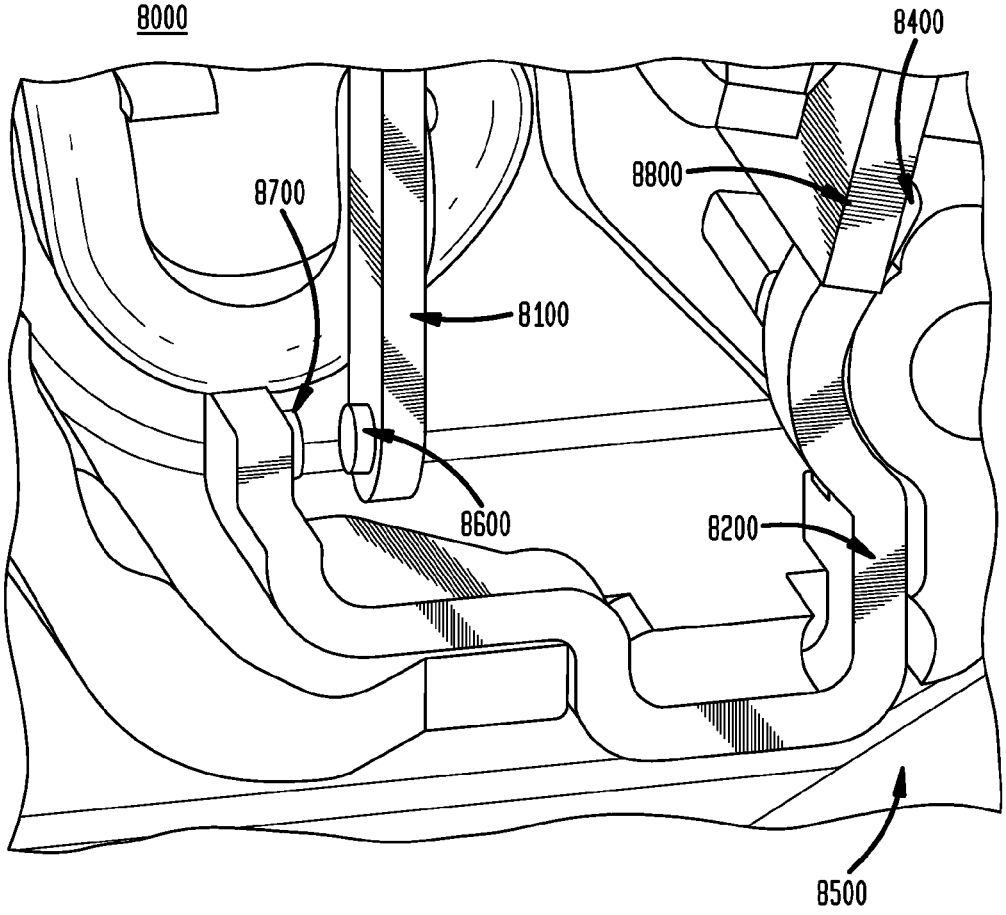
FIG. 8 is a perspective view of an exemplary embodiment of a system 8000.

FIG. 8 is a perspective view of an exemplary embodiment of a system 8000, which can comprise a bimetal 8100 and a bimetal restraint 8200. Bimetal 8100 can comprise and/or be attached to a bimetal contact 8600. Bimetal restraint 8200 can comprise and/or be attached to a bimetal restraint contact 8700. In certain exemplary embodiments, bimetal restraint 8200 can be adapted to form a shunt for electrical energy within system 8000. Bimetal restraint 8200 can comprise a shunt end 8400, which can be electrically coupled to a lug 8800. Lug 8800 can be electrically coupled to a load side of a breaker of system 8000 and/or a downstream electrical circuit.

Bimetal restraint 8200 can be adapted to restrain bimetal 8100 of a circuit breaker from deformation beyond a predetermined threshold during a short circuit event. Bimetal restraint 8200 can be adapted to act as a shunt during the short circuit event to transfer electrical energy from an electrical energy source to a load side lug of the circuit breaker. Bimetal restraint 8200 might not be attached to a cover of the circuit breaker. Bimetal restraint 8200 can be nondestructively detachable from a case 8500 of the circuit breaker in an operative embodiment. Bimetal restraint 8200 can be adapted for fastenerless installation in case 8500 of the circuit breaker.

In certain exemplary embodiments, electromechanical conditions in the circuit breaker can cause bimetal contact

8600 to become electrically coupled to bimetal restraint contact 8700. Electrical energy can be conducted from bimetal 8100, via bimetal contact 8600, bimetal restraint contact 8700, and bimetal restraint 8200, to lug 8800. Each of bimetal contact 8600 and bimetal restraint contact 8500 can be adapted to potentially resist, reduce, minimize, limit, and/or prevent unwanted arc-based erosion and/or arc-based deposition involving one or more surfaces of bimetal 8100 and/or bimetal restraint 8200.

Figure 9:
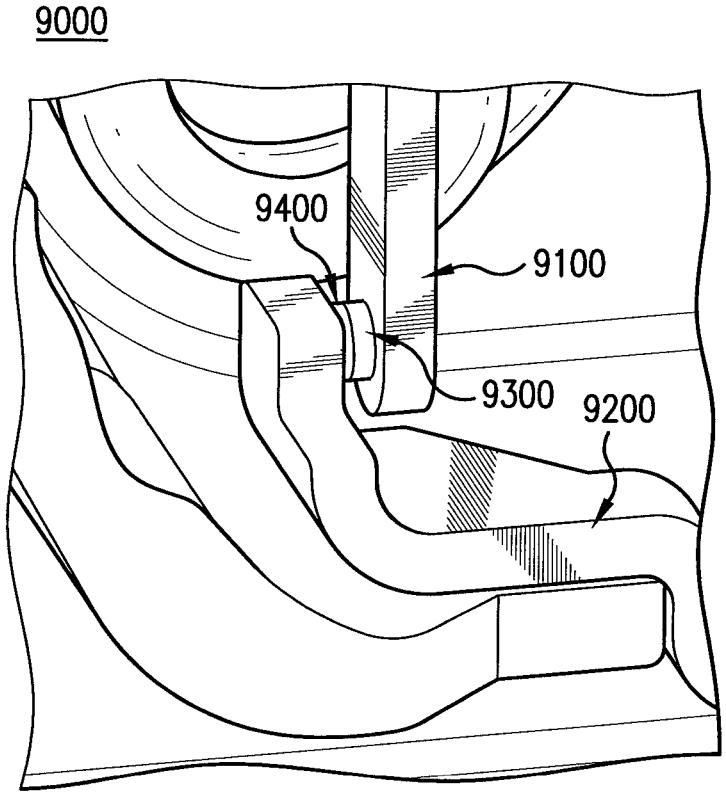
FIG. 9 is a perspective view of an exemplary embodiment of a system 9000.

FIG. 9 is a perspective view of an exemplary embodiment of a system 9000, which can comprise a bimetal 9100 and a bimetal restraint 9200. Bimetal 9100 can comprise and/or be attached to a bimetal contact 9300. Bimetal restraint 9200 can comprise and/or be attached to a bimetal restraint contact 9400. In certain operative embodiments, such as illustrated in system 9000, responsive to electromagnetic conditions within the circuit breaker, bimetal contact 9300 can become electrically coupled to bimetal restraint contact 9400 thereby forming a shunt for electrical energy between bimetal 9100 and a load side of a circuit breaker of system 9000.

Figure 10:
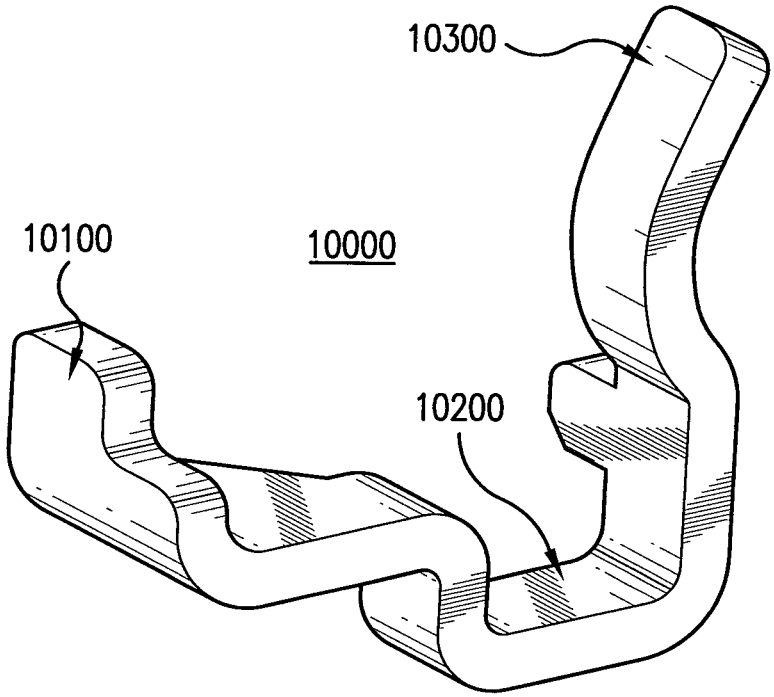
FIG. 10 is a perspective view of an exemplary embodiment of a bimetal restraint 10000.

FIG. 10 is a perspective view of an exemplary embodiment of a bimetal restraint 10000, which can comprise a bimetal end region 10100, a recessed portion 10200, and/or a shunt end region 10300. Bimetal end region 10100 can be adapted, in certain operative embodiments, to restrain motion of a bimetal in a circuit breaker and/or electrically couple bimetal restraint 10000 to the bimetal. Recessed portion 10200 can be adapted, in certain operative embodiments, to contact one or more surfaces of an associated circuit breaker to restrain motion of bimetal restraint 10000 relative to the circuit breaker. Bimetal restraint 10000 can be adapted to be fastenerlessly installed in the circuit breaker. Shunt end region 10300 can be adapted to be electrically coupled to a load side of the circuit breaker. Bimetal restraint 10000 can be adapted, in certain operative embodiments, to act as a shunt and route excess and/or unwanted electrical energy from the bimetal to the load side of the circuit breaker.

Figure 11:
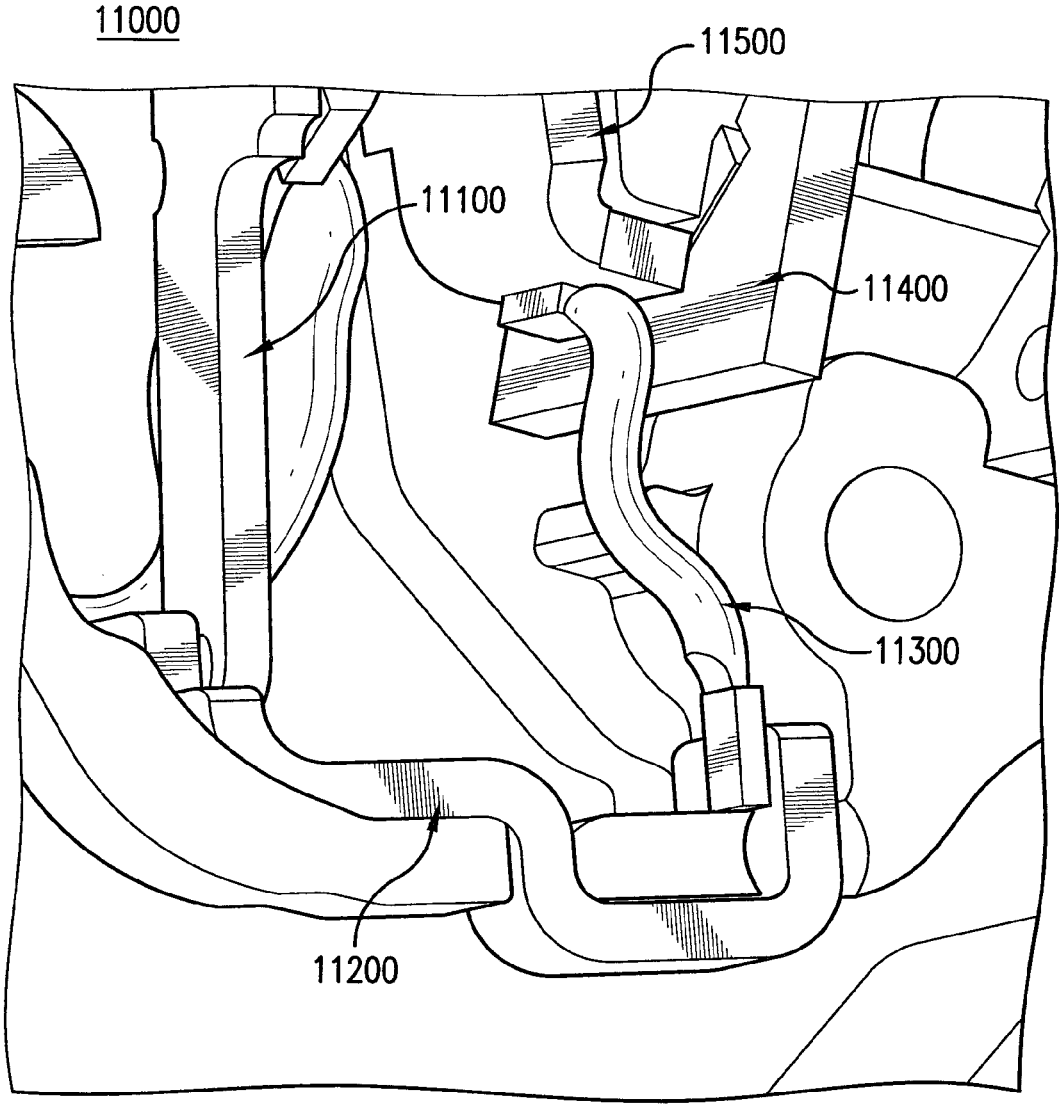
FIG. 11 is a perspective view of an exemplary embodiment of a system 11000.

FIG. 11 is a perspective view of an exemplary embodiment of a system 11000, which can comprise a bimetal 11100 and a bimetal restraint 11200. Bimetal restraint 11200 can be attached and/or electrical coupled to a braid 11300. Braid 11300 can be electrically coupled to a lug 11400 and/or a load terminal 11500 of a circuit breaker of system 11000. Under conditions wherein bimetal 11100 becomes electrically coupled to bimetal restraint 11200, electrical energy can flow from bimetal 11100, via bimetal restraint 11200 and braid 11300, to lug 11400. The electrical energy can thereby be transmitted to a load associated with the circuit breaker.

Figure 12:
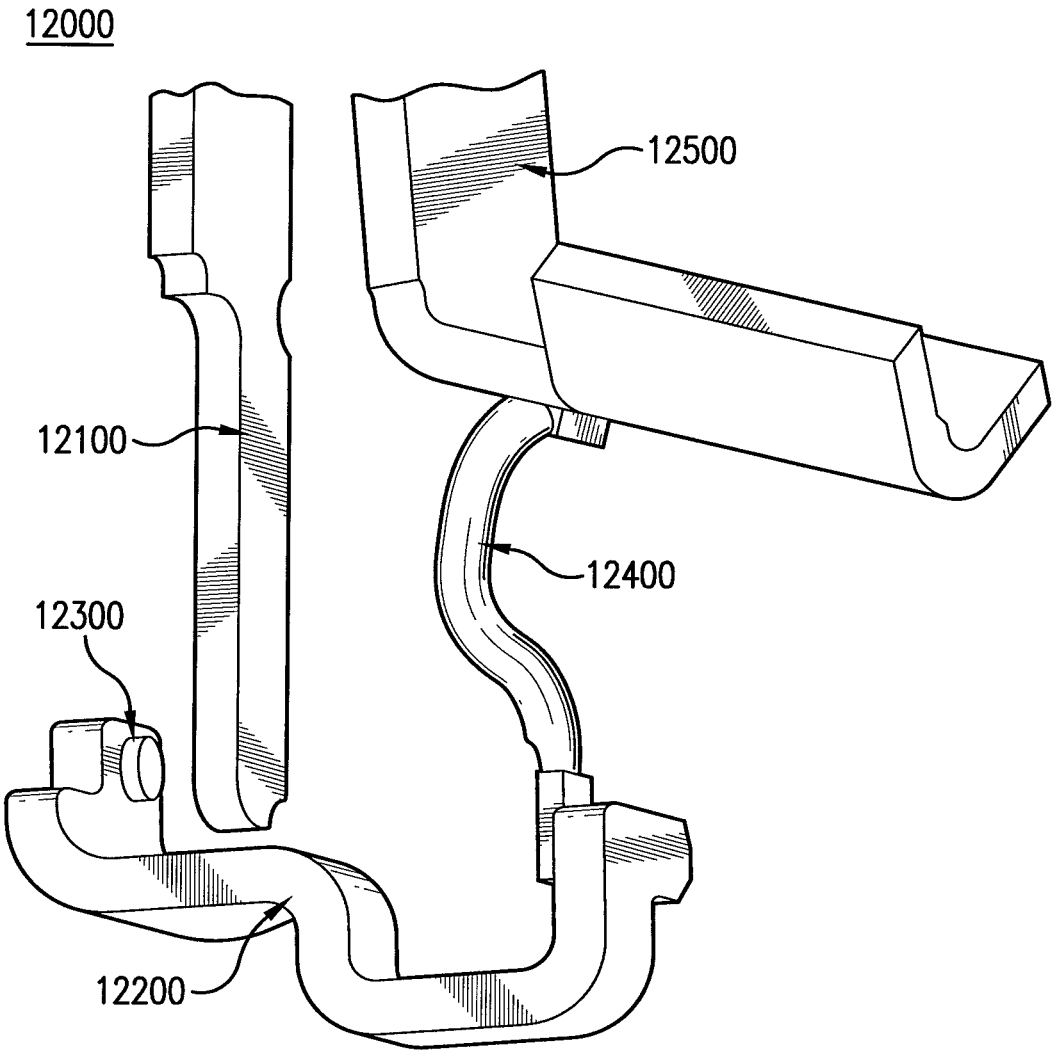
FIG. 12 is a perspective view of an exemplary embodiment of a system 12000.

FIG. 12 is a perspective view of an exemplary embodiment of a system 12000, which can comprise a bimetal 12100 and a bimetal restraint 12200. Bimetal restraint 12200 can be attached and/or electrical coupled to a braid 12400. Bimetal restraint 12300 can comprise and/or be attached to a bimetal restraint contact 12300. Braid 12400 can be electrically coupled to a load terminal 12500 of a circuit breaker of system 12000. Under conditions wherein bimetal 12100 becomes electrically coupled to bimetal restraint 12200, electrical energy can flow from bimetal 12100; via bimetal restraint contact 12300, bimetal restraint 12200, and braid 12400; to load terminal 12500. The electrical energy can thereby be transmitted to a load associated with the circuit breaker.

Figure 13:
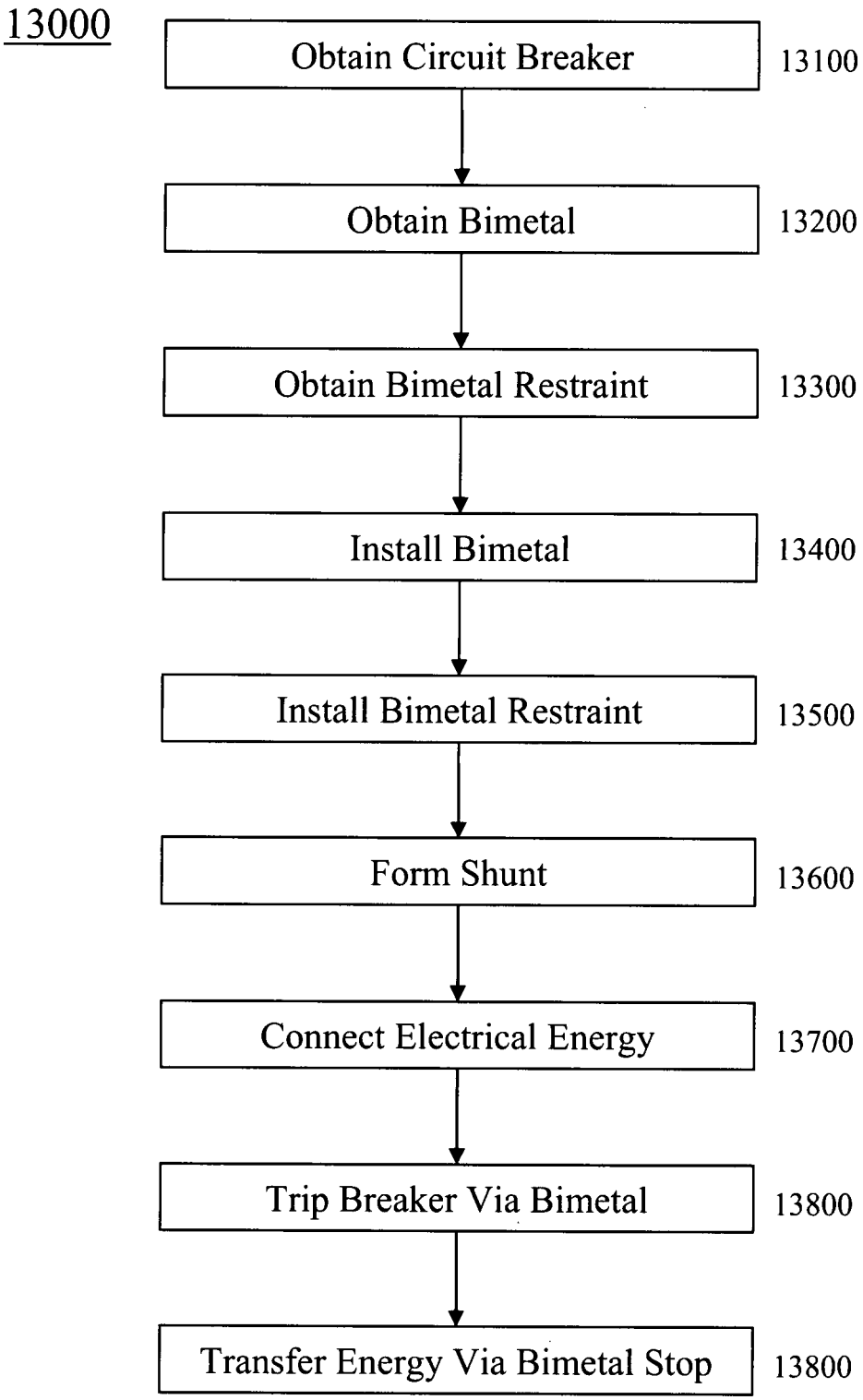
FIG. 13 is a flowchart of an exemplary embodiment of a method 13000.

FIG. 13 is a flowchart of an exemplary embodiment of a method 13000. At activity 13100, a circuit breaker can be obtained.

At activity 13200, a bimetal, adapted to be operatively installed in the circuit breaker, can be obtained. The bimetal can comprise two metals, such as two metals selected from the group of copper, aluminum, zinc, tin, steel, and/or alloys thereof. At activity 13300, a bimetal restraint can be obtained. At activity 13400, bimetal can be installed in the circuit breaker. Note that, in certain embodiments, this activity can occur prior to activity 13300.

At activity 13500, the bimetal restraint can be installed in the circuit breaker. The bimetal restraint can be adapted to be fastenerlessly installed in the circuit breaker and/or releasably attached to the circuit breaker without being heatedly fused and/or installed via a fastener to one or more components comprised by the circuit breaker. For example, the lug end portion of the electrical bypass conductor can be slid between two or more surfaces of a case of the circuit breaker. The bimetal restraint can be adapted to restrain the bimetal from deformation beyond a predetermined threshold during a short circuit event. The bimetal restraint can be adapted to act as a shunt during the short circuit event to transfer electrical energy from an electrical energy source to a load side lug of the circuit breaker. In certain exemplary embodiments, the bimetal restraint might not be attached to a cover of the circuit breaker. In certain exemplary embodiments, the bimetal restraint can be releasably installed and can be adapted to be substantially nondestructively removed from the circuit breaker case.

At activity 13600, a shunt and/or electrically conductive path can be formed via which electrical current can flow between the bimetal and a load side of the circuit breaker. The shunt can be adapted to transfer electrical energy to the load side of the circuit breaker during the short circuit event. The bimetal restraint can comprise a shunt end portion adapted to be operatively electrically coupled and/or fastenerlessly attached to the lug and/or a load terminal of the load side of the circuit breaker.

At activity 13700, electrical energy can be operatively connected to the circuit breaker.

At activity 13800, a circuit breaker can be tripped via the bimetal, such as due to a temperature of the bimetal exceeding a predetermined threshold.

At activity 13900, electrical energy associated with the short circuit can be transferred to the load side lug of the circuit breaker via the bimetal restraint. The bimetal restraint can be adapted to attempt to reduce wear and/or damage to other components of the circuit breaker resulting from excessive electrical currents and/or voltages incident to the short circuit.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

act—to operate and/or function in a particular manner.

activity—an action, act, deed, function, step, and/or process and/or a portion thereof.

adapted to—suitable, fit, and/or capable of performing a specified function.

allow—to provide, let do, happen, and/or permit.

armature latch—a moveable component of a circuit breaker that releasably fastens and/or holds the operating mechanism of the circuit breaker.
at least—not less than.
attach—to fasten, secure, couple, and/or join.
between—in a separating interval and/or intermediate to.
beyond—
bias—n. a tension and/or force; v. to urge and/or force.
bimetal—a device made by the bonding of two sheets, strips, and/or layers of different metals, the metals having differing coefficients of thermal expansion, the device adapted to trigger a disconnecting of electrical energy from a circuit when thermally deformed beyond a predetermined threshold.
bimetal restraint—a device adapted to restrain motion of a bimetal in a circuit breaker.
by—with the use of.
bypass—to avoid by using an alternative.
case—a container adapted to substantially enclose something.
circuit breaker—a re-settable device adapted to automatically open an alternating current electrical circuit to protect the circuit from damage caused by overload and/or short circuit.
component—a constituent element and/or part.
comprising—including but not limited to, what follows.
contact arm—a member comprising one of a pair of electrical contacts engageable to close a circuit.
couple—to join, connect, and/or link two things together.
cover—a substantially planar object configured to protect and/or conceal.
define—to establish the meaning, relationship, outline, form, and/or structure of; and/or to precisely and/or distinctly describe and/or specify.
deformation—a
device—an instrumentality adapted to a particular purpose.
detach—the opposite of attach.
during—at some time in a time interval.
electrical—relating to producing, distributing, and/or operating by electricity.
electrical energy—energy characterized by, and/or adapted to cause, a flow of electric charge through a conductor.
electrically couple—to connect in a manner adapted to allow a flow of electricity therebetween.
event—an occurrence.
fasten—to attach to something else and/or to hold something in place.
fastener—a distinct restraint that attaches two or more things. A fastener can be a screw, bolt, hook and/or loop of a hook and loop fastener system, button, hook, catch, snap, latch, buckle, loop, tie, clamp, connector, coupler, link, band, zipper, releasable adhesive, plug and socket, and/or any other releasable means for attachment, and/or a glue, bond, weld, and/or any other permanent means for attachment
fastenerless—adapted to be positioned and/or retained at a predetermined location and/or adapted to limit motion and/or rotation in one or more predetermined directions without utilizing a fastener. Examples can include tongue and groove joints, wedges, and/or a self-biased interaction between a first part and a second part, etc.
first—being before all others in an ordering.
for—with a purpose of.
from—used to indicate a source.
further—in addition.
fuse—to melt together.
heat—energy associated with the motion of atoms and/or molecules and capable of being transmitted through solid and fluid media by conduction, through fluid media by convection, and through a fluid and/or empty space by radiation.
heatedly—via thermal energy.
install—to place in position and/or connect for service and/or use.
installation—a state of being installed.
load side—a portion of an electric circuit breaker that is electrically coupled to at least one electricity utilizing device.
lug—an electrical terminal adapted to be electrically coupled to a conductor, the conductor electrically couplable to an electrical energy source.
method—a process, procedure, and/or collection of related activities for accomplishing something.
more—greater.
movement—a change in position from one location to another.
nondestructively—to perform substantially without damaging.
not—a negation of something.
occur—to take place.
one—a singular unit.
operative embodiment—an implementation that is in operation and/or is working as designed.
pass—to move relative to an object.
passage—a motion of a first object relative to a second object.
plurality—the state of being plural and/or more than one.
power—energy, a measure of energy and/or work, and/or a rate at which work is done, expressed as the amount of work per unit time and commonly measured in units such as watt and horsepower.
predetermined threshold—a limit established in advance.
primary—first in an ordering.
prong—a projecting part, such as a protrusion, bar, stub, rod, pin, cylinder, etc.
protect—to attempt to prevent and/or avoid damage.
provide—to furnish or supply.
releasably—capable of being freed, in a substantially nondestructive manner, from something that binds, fastens, or holds back.
remove—to eliminate, remove, and/or delete, and/or to move from a place or position occupied.
responsive—reacting to an influence and/or impetus.
rest—to not move and/or be supported by.
restrain—to limit and/or restrict.
said—when used in a system or device claim, an article indicating a subsequent claim term that has been previously introduced.
seat—to attach to or place firmly in or on something.
second—being immediately after a first item in an exemplary ordering.
secondary—second in an ordering.
shape—a characteristic surface, outline, and/or contour of an entity.
short circuit—an abnormal condition of relatively low resistance between two points of different potential in a circuit resulting in an excess flow of current relative to the range of currents typically conducted via the circuit.
shunt—a device adapted to divert a flow of electrical current.
similar—having a resemblance.
source—an original and/or intermediate transmitter of electrical energy and/or a related group of such transmitters and/or a point at which something originates, springs into being, and/or from which it derives and/or is obtained.

springably—elastically movable from a first position to a second position.

substantially—to a considerable, large, and/or great, but not necessarily whole and/or entire, extent and/or degree.

surface—the outer boundary of an object or a material layer constituting or resembling such a boundary.

system—a collection of mechanisms, devices, data, and/or instructions, the collection designed to perform one or more specific functions.

tension—a deformation of an at least partially elastic body.

terminal—a mechanical device via which an electric connection to an apparatus is established.

that—used as the subject or object of a relative clause.

therebetween—in an interval separating a first thing from a second thing.

therethrough—in one end and out another end of an object.

tool—something used to accomplish a task.

transfer—(n) a transmission from one device, place, and/or state to another. (v) to convey from one device, place, and/or state to another.

two—a cardinal number equal to one plus one.

via—by way of and/or utilizing.

wherein—in regard to which; and; and/or in addition to.

without—not accompanied by.

Note

Still other practical and useful embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application.

Thus, regardless of the content of any portion (e.g., title, field, background, summary, abstract, drawing figure, etc.) of this application, unless clearly specified to the contrary, such as via an explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

any elements can be integrated, segregated, and/or duplicated;

any activity can be repeated, performed by multiple entities, and/or performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

Accordingly, the descriptions and drawings are to be regarded as illustrative in nature, and not as restrictive.

What is claimed is:

1. A system comprising:

a bimetal restraint adapted to restrain a bimetal of a circuit breaker from deformation beyond a predetermined threshold during a short circuit event, said bimetal restraint adapted to act as a shunt during said short circuit event to transfer electrical energy from an electrical energy source to a load side lug of said circuit breaker, said bimetal restraint not attached to a cover of said circuit breaker and said bimetal restraint releasably seated in a circuit breaker case of said circuit breaker.

2. The system of claim 1, further comprising:

said bimetal.

3. The system of claim 1, further comprising:

said circuit breaker.

4. The system of claim 1, further comprising:

a load terminal of said circuit breaker, said load terminal electrically coupled to said load side of said circuit breaker.

5. The system of claim 1, further comprising:

said load side lug.

6. The system of claim 1, further comprising:

an armature latch of said circuit breaker, said armature latch adapted to remove electrical energy from a load side of said circuit breaker responsive to a movement of said bimetal.

7. The system of claim 1, further comprising:

a contact attached to said bimetal restraint.

8. The system of claim 1, further comprising:

said circuit breaker case, said bimetal restraint releasably seated in said circuit breaker case without a fastener.

9. The system of claim 1, further comprising:

said circuit breaker case, said bimetal restraint releasably springably seated between at least two surfaces of said circuit breaker case.

10. The system of claim 1, further comprising:

said circuit breaker case, said bimetal restraint releasably seated in said circuit breaker case, said bimetal restraint resting on at least one surface defined by said circuit breaker case.

11. The system of claim 1, further comprising:

said circuit breaker case, said bimetal restraint biasedly seated in said circuit breaker case.

12. The system of claim 1, further comprising:

said circuit breaker case, said bimetal restraint fastened via tension in said circuit breaker case.

13. The system of claim 1, further comprising:

said circuit breaker case, said bimetal restraint nondestructively removable from said circuit breaker case.

14. The system of claim 1, further comprising:

said circuit breaker case, said bimetal restraint nondestructively removable from said circuit breaker case without a tool.

15. The system of claim 1, wherein said bimetal restraint comprises a prong adapted to restrain said bimetal.

16. A device comprising:

a bimetal restraint adapted to restrain a bimetal of a circuit breaker from deformation beyond a predetermined threshold during a short circuit event, said bimetal restraint adapted to act as a shunt during said short circuit event to transfer electrical energy from an electrical energy source to a load side lug of said circuit breaker, said bimetal restraint nondestructively detachable from a case of said circuit breaker in an operative embodiment, said bimetal restraint adapted for fastenerless installation in said case of said circuit breaker.

17. A method comprising a plurality of activities, comprising:

installing a bimetal restraint adapted to restrain a bimetal of a circuit breaker from deformation beyond a predetermined threshold during a short circuit event, said bimetal restraint adapted to act as a shunt during said short circuit event to transfer electrical energy from an electrical energy source to a load side lug of said circuit breaker, said bimetal restraint not attached to a cover of said circuit breaker.

18. The method of claim 17, wherein removing said bimetal from said case.

19. The method of claim 17 wherein electrically coupling said circuit breaker to said electrical energy source.

* * * * *